United States Patent [19]

Armstead

[11] Patent Number: 4,901,650

[45] Date of Patent: Feb. 20, 1990

[54] INDUSTRIAL PALLET HAVING UPWARD EXTENDING SUPPORT POSTS AND LOCKING MEANS

[76] Inventor: Richard L. Armstead, 219 Hwy 52, Erie, Colo. 80516

[21] Appl. No.: 376,975

[22] Filed: Jul. 6, 1989

Related U.S. Application Data

[63] Continuation of Ser. No. 179,152, Apr. 8, 1988, abandoned.

[51] Int. Cl.[4] ..... B65D 19/12

[52] U.S. Cl. ..... 108/55.1; 108/56.1; 211/186

[58] Field of Search ..... 108/55.1, 55.3, 55.5, 108/53.1, 53.3, 53.5, 56.1; 211/207, 186, 188, 189, 190

[56] References Cited

U.S. PATENT DOCUMENTS

| | | | |
|---|---|---|---|
| 2,988,313 | 6/1961 | Ellison | 108/53.5 |
| 3,101,128 | 8/1963 | Dane | 108/55.1 X |
| 3,168,060 | 2/1965 | Farley | 108/55.1 X |
| 3,565,018 | 2/1971 | Jay | 108/55.1 X |
| 3,602,368 | 8/1971 | Gould | 108/55.1 X |
| 3,857,494 | 12/1974 | Giardini | 108/55.1 X |
| 4,295,431 | 10/1981 | Stanlo | 108/55.1 |
| 4,571,141 | 2/1986 | Gieson | 108/55.1 X |
| 4,673,092 | 6/1987 | Lamson et al. | 108/53.1 X |

FOREIGN PATENT DOCUMENTS

| | | | |
|---|---|---|---|
| 629667 | 3/1963 | Belgium | 108/55.1 |

*Primary Examiner*—Kenneth J. Dorner
*Assistant Examiner*—José V. Chen
*Attorney, Agent, or Firm*—Earl C. Hancock; Francis A. Sirr

[57] ABSTRACT

An industrial pallet is constructed and arranged to support a vertical stack of scaffold end frames on the pallet's rectangular, horizontal support platform. Upwardly extending channel-iron members are rigidly secured adjacent the back edge and the two side edges of the platform. These channel-iron members define an open-front cavity for receiving the end frames as they are manually inserted onto the platform from the front edge thereof. Horizontal hand-rail/brace members extend between the side disposed channel-iron members, to form both hand rails and a platform for supporting tube-shaped scaffold cross members that are used with the scaffold end frames when constructing a scaffold. Two vertically extending, removable, locking rods fit into sockets carried by the platform. When these locking rods are manually inserted into the platform sockets, the rods penetrate interior spaces of the stacked scaffold end frames. The upper ends of the locking rods are disposed to cooperate with locking links that are pivotally attached to the rear disposed channel-iron members. The locking links can be padlocked in place on the upper ends of the locking rods, to prevent unauthorized removal of the scaffold end frames. The bottom of the platform includes pallet support feet constructed and arranged to cooperate with the lifting members of a fork lift truck.

6 Claims, 3 Drawing Sheets

INDUSTRIAL PALLET HAVING UPWARD EXTENDING SUPPORT POSTS AND LOCKING MEANS

RELATED APPLICATION

This application is a continuation of copending application, Serial No. 07/179,152, filed Apr. 8, 1988, now abandoned for INDUSTRIAL PALLET HAVING UPWARD EXTENDING SUPPORT POSTS AND LOCKING MEANS.

DESCRIPTION

1. Field of the Invention

This invention relates to the field of industrial platforms or pallets, and more particularly to pallets constructed and arranged to support scaffold end frames, and the like, wherein a pallet platform includes upright, edge-disposed members that operate to confine a stack of end frames, the edge-disposed members including means for locking the stack of end frames onto the pallet.

2. Background and Summary of the Invention

In the prior art, scaffold end frames and their tubular cross members have for the most part been loosely piled in place for storage, or at best they have been placed on a conventional platform pallet for storage. Prior art methods of storage generally lead to multiple manual handling of the scaffold members, bending of the scaffold members, and/or filling of the hollow legs of the scaffold members with mud, dirt and the like.

Prior art means for storing the various metal scaffold members from which a scaffold can be manually constructed has proven to be time consuming, and requires an unusual amount of labor to place the scaffold ends and cross members in storage, and then later retrieve them as another scaffold is manually constructed. In addition, unless the scaffold ends are stored in a locked enclosure or building, the scaffold members are subject to unauthorized removal.

The present invention provides a multiple utility pallet having special utility for the storage and transportation of construction industry tools such as scaffold ends, cross members, and associated means.

An object of the invention is to provide a pallet whose use in the construction industry provides a high degree of time and labor saving advantage.

When the present invention is used to store and/or transport scaffold members, workers can dismantle a scaffold and place the scaffold parts directly on the pallet of the invention. The loaded pallet can then be placed in storage, and later retrieved when another scaffold is to be constructed. This new scaffold can be manually constructed directly from the pallet of the invention. Thus, damage to the scaffold parts, as might result from multiple handling of the scaffold parts, is minimized.

In addition, the present invention provides a unique locking means to prevent unauthorized removal of the scaffold parts during storage, transportation, and the like.

As will be apparent, when the pallet of the invention is not used for the storage/transportation of parts such as scaffold parts, the pallet may be used as a work or material platform in industries such as the construction industry.

These and other objects advantages of the invention will be apparent to those of skill in the art upon reference to the following enabling description of preferred embodiments of the invention.

Figure 1:
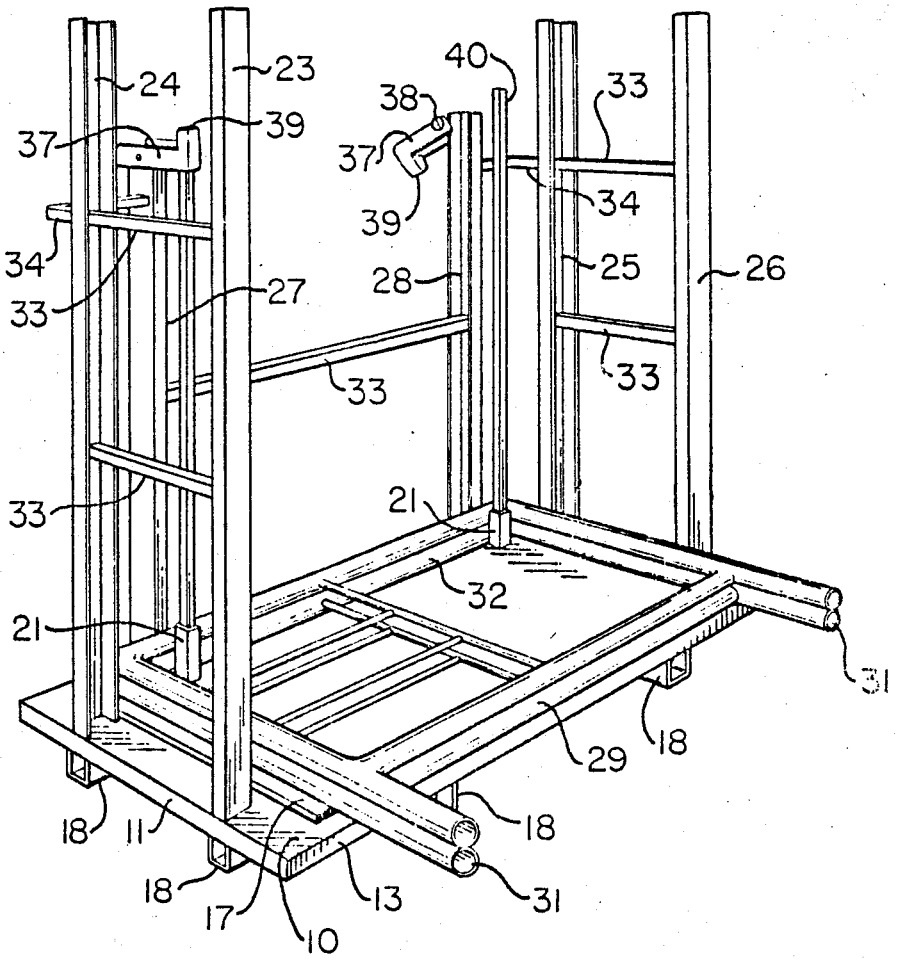
FIG. 1 is a front, left side perspective view of a pallet constructed in accordance with the invention.

FIG. a front view of the pallet of FIG. 1;

FIG. a top view of the pallet of FIG. 1;

FIG. a bottom view of the pallet of FIG. 1; and

FIGS. 6–8 are views of the locking means of the pallet of FIG. 1.

DETAILED DESCRIPTION OF THE INVENTION

The present invention will be described in relation to its preferred utility wherein the pallet of the invention supports, stores and is used to transport scaffold end frames, cross members and planking from which a scaffold may be constructed. Scaffolds of this general type are used, for example, in the building construction industry, in a manner well known by those of skill in the art. However, other utility for the pallet of the present invention will be apparent to those of skill in the art. Therefore, the spirit and scope of the present invention is not to be limited by the following detailed description of preferred embodiments thereof.

A preferred embodiment of the invention is an industrial pallet. Thus, the pallet is constructed primarily of metal channel-iron and square metal tubing. While these members are preferably welded together to form the pallet, it is within the teachings of the invention to bolt the members together. This later method of construction is of some advantage when it is necessary to disassemble the pallet for shipment of a number of pallets from one location to another.

Figure 4:
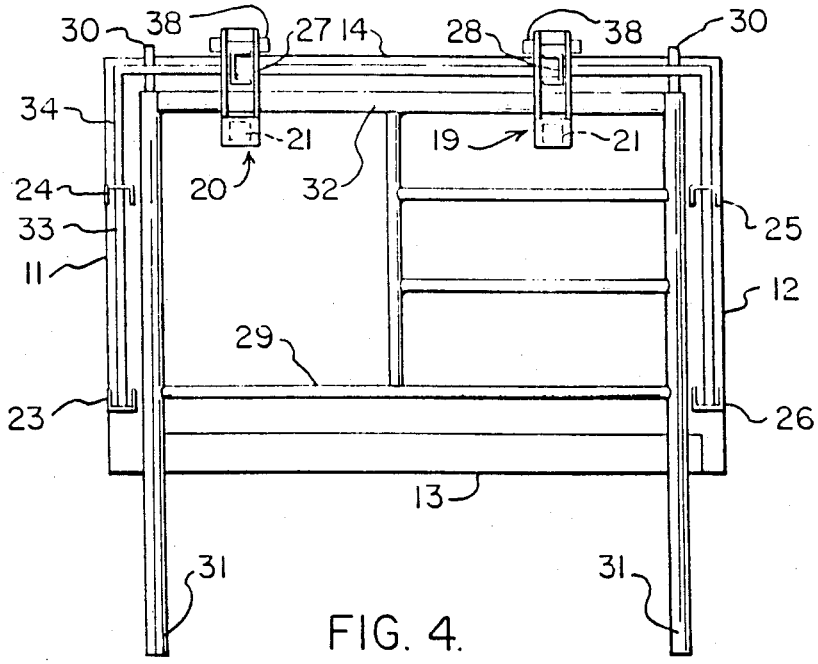

The horizontal base platform 10 of the pallet is in the shape of a rectangle having, for example, 3 feet 9 inch side edges 11 and 12 and 5 foot 7 inch front and rear edges 13 and 14, best seen in FIG. 4. This rectangular size is only somewhat larger than the planar size of a scaffold end frame, and the pallet's 5 foot 7 inch dimension allows scaffold cross members to be supported thereon, as will be described.

Pallet platform 10 may take a variety of detailed forms. In a preferred embodiment, it was constructed of welded 4-inch channel-iron (U-shaped profile facing down), having cross members 15 and 16 (See FIG. 5) upon which a replaceable plywood panel 17 (See FIG. 1) is supported. In an alternative construction, the support surface of platform 10 may comprise a solid metal sheet, or an expanded metal screen.

The underside of platform 10 includes four pairs of support feet 18, one pair being welded along each of the four edges of the platform. These members are constructed of metal. These feet members support platform 10 on the ground or the like, and each pair of feet define two spaced, parallel, and generally horizontal channels for the insertion of the lifting fingers of a fork lift truck or the like as is best seen in FIG. 1. Thus, the pallet may be selectively lifted from any of its four sides.

Figure 5:
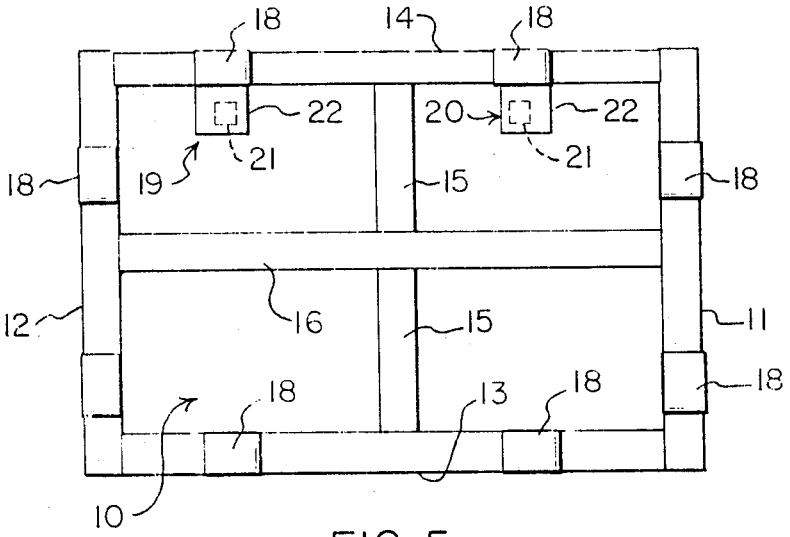

The two rear corners of platform 10 include upward facing socket means 19 and 20. While these socket means may take a variety of forms, in a preferred embodiment they each comprised a short section of vertically extending square metal tubing 21 that was welded to a horizontal metal plate 22 as is best seen in FIG. 5.

Plate 22 was welded to the platform's adjacent channel-iron member. With this construction and arrangement, plywood panel 17 (FIG. 1) is provided with mating openings that facilitate placement of the panel over metal tubing 21. In this way, the plywood panel is generally fixed in place.

A preferred embodiment of the invention, without limitation thereto, includes three pairs of upward extending support posts and two removable locking rods. It will be apparent to those of skill in the art that the construction and arrangement of this support/locking arrangement may take other detailed forms without departing from the spirit and scope of the invention.

More specifically, the two side edge portions 11 and 12 of platform 10 each include a pair of vertically extending 3-inch channel-iron support posts, the individual posts being identified by reference numerals 23–26. An exemplary height for posts 23–26 is 5 foot 8 inches. These 3-inch channel-iron posts are welded generally flush with the outer edge of the platform's 4-inch channel-iron members as shown in FIG. 1. Thus, about a 1-inch ledge is provided on which the peripheral edge of plywood panel 17 is supported.

The rear edge 14 of platform 10 includes the third of the three pairs of support posts, comprising vertically extending posts 27 and 28. Posts 27 and 28 are preferably shorter than posts 23–26, and are, for example 5 feet 2 inches high. The position of posts 27–28 along rear edge 14 of the platform is not critical. However, posts 27–28 should be located in general alignment with the platform's socket means 19–20, to facilitate the locking function of the present invention, as will be described. In addition, posts 27–28 are located so as not to interfere with placement of scaffold end frames 29 on platform 10, as shown in the various figures.

The pallet as thus far described comprises an open top, closed bottom, three-sided storage cavity, as is defined by platform 10 and posts 23–29. Scaffold end frame members 29 may be inserted into this cavity, over the front edge 13 of the platform. As shown, end frames 29 are placed on platform 10 in lying down attitude, with the upper end pins 30 (See FIG. 4) of the end frames facing to the rear of platform 10, with the lower open ends of frame legs 31 facing to the front of platform, with frame legs 31 closely adjacent to the inner surface of posts 23–26, and with the upper rail 32 of the end frames closely adjacent to the inner surface of posts 27–28.

In an embodiment of platform socket means 19–20 where metal tubing 21 extends upward above the upper surface of plywood panel 17, the lower ones of end frames 29 are generally secured in place by upward extension of metal tubing 21 as is best seen in FIG. 1.

Posts 23–28 are secured together by side and rear metal tubing members 33 and rear corner metal tubing members 34.

Figure 2:
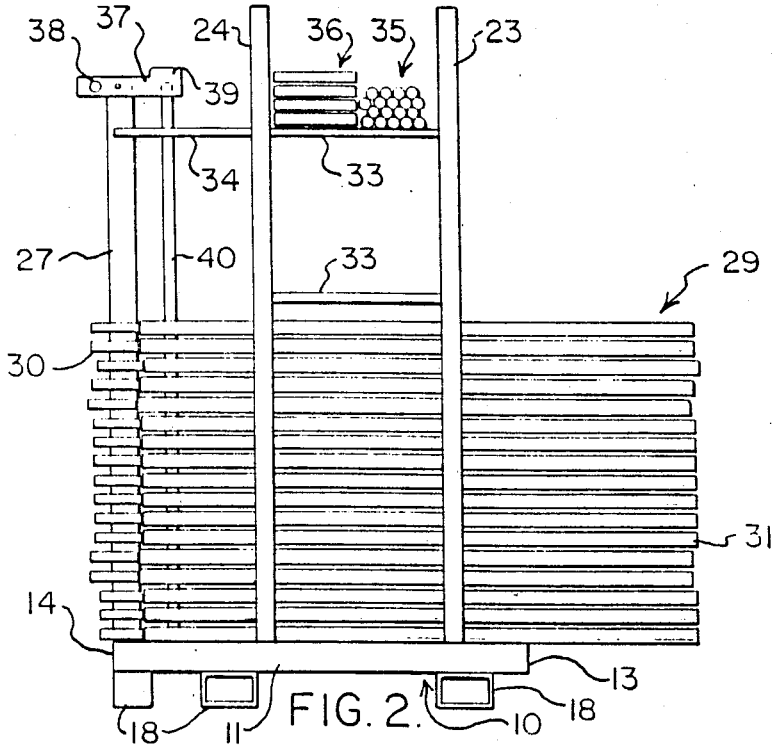
FIG. 2 is a left side view of the pallet of FIG. 1.

Side tubing members 33 extend generally horizontal and parallel to platform 10, and are welded between side posts 23–26, as shown. The vertical location of tubing members 33 is not critical. However, it is desirable that they function as hand rails and provide a second horizontal storage plane that is parallel to the storage plane provided by platform 10, and upon which scaffold cross members 35 and/or scaffold planking 36 may be supported and stored, as shown in FIG. 2.

Figure 3:
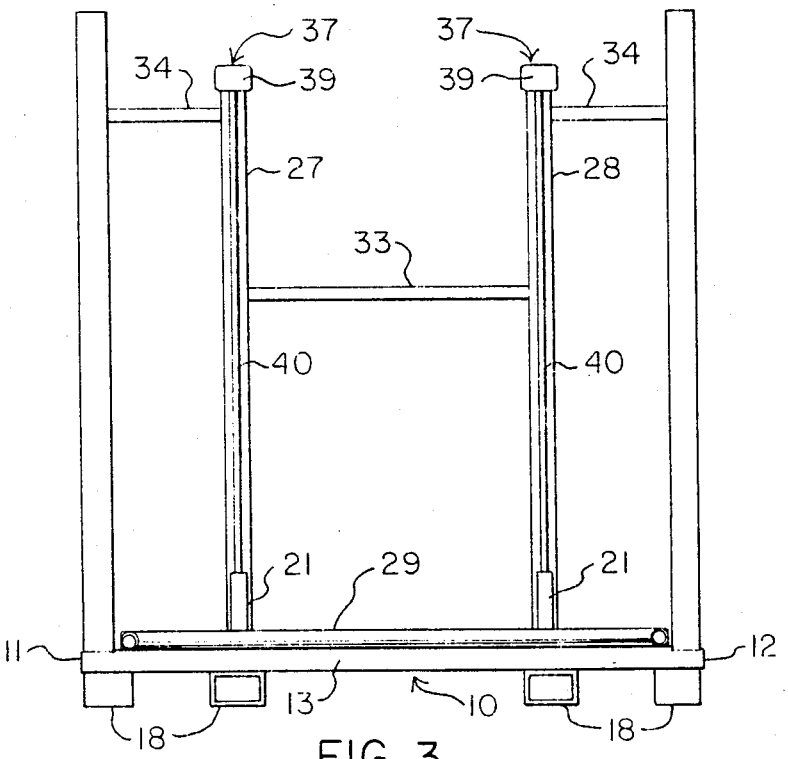

With reference particularly to FIGS. 6–8, rear support posts 27–28 are secured to each other by welding attachment of a horizontal tubing member 33 as shown in FIGS. 1 and 3. Posts 27–28 are also secured to the adjacent one of the side post pairs by welding attachment of horizontal, right-angle tubing members 34, best seen in FIG. 1.

The upper end of each of the posts 27–28 pivotally mounts a locking link 37. Each of the links 37 is secured to its post by means of a pin 38 that non-removably secures the link to its post. The extending end of each link 37 includes a cup portion or socket portion 39. When link 37 is pivoted to its horizontal position, as shown by dotted line in FIG. 6, over platform 10, cup portion 39 is in general vertical alignment with one of the platform's socket means 19–20.

As can be seen in FIGS. 1 and 4, when a plurality of planar end frames 29 are placed in a stack on platform 10, the generally similarly located openings 100 and 101 in each of the end frames are placed in vertical alignment. In order to secure the stack of scaffold end frames 29 to the pallet, a pair of metal locking rods 40 are provided. These rods preferably comprise square metal tubing. In order to lock the stack of end frames to the pallet, the two rods 40 are manually inserted through an opening in the stack of end frames as is best seen in FIG. 1, from the top of the stack toward the bottom, to place the lower end of each rod in a socket means 19–20 of platform 10. The two locking links 37 are then pivoted to their horizontal position (i.e. the dotted position of FIG. 6), placing cup portions 39 over the top ends of rods 40. Locking means, such as padlocks (not shown), are now inserted through the mating openings 41 and 42 in links 37 and posts 27–28, respectively (See FIG. 6).

The Details of construction shown for links 37 are not critical to the invention. In its broader sense, links 37 comprise any means operable to secure and/or lock the upper portion of one or both rods 40 to the pallet.

In the absence of a locking means in place, the construction and arrangement of rods 40 and links 37 operate to secure the stack of end frames from shifting during transportation and the like. When links 37 are locked to support posts 27–28, the additional function of preventing unauthorized removal of the end frames is accomplished.

As those skilled in the art will readily appreciate, other means of locking the pallet's material load to the pallet will be apparent to those skilled in the art, and the above detailed description is not to be taken as a limitation on the present invention.

An exemplary use of the pallet of the invention occurs upon the completion of a building construction phase. At this time, empty pallets are delivered to the construction site, the scaffolding is disassembled, and the scaffold elements are loaded onto the pallet as the scaffold is disassembled piece by piece. Locking rods 40 are then inserted in place, and perhaps locked in place. The pallet is then ready to be moved to storage or to another construction site. Note however, that the scaffold elements have been handled only once during this process. When a new scaffold is to be erected, loaded pallets are delivered to the construction site, links 37 are unlocked, rods 40 are removed, and the scaffolding elements are removed from the pallet one by one, and as the scaffold is erected. Again the scaffolding elements are handled only once.

Thus far, the utility of the invention has been described relative to the storing, transportation, etc. of scaffolding elements. However, other utility will be apparent to those of skill in the art. For example, after a scaffold has been erected, and the pallet is now empty, the pallet may be elevated by operation of a fork lift truck or the like, and platform 10 may be used to support a workman and his tools adjacent a building portion. In this case, metal tubing 33 functions as a hand rail, and operates to protect the workman. An alternative construction would provide metal screening attached to posts 23–28 in such a manner as not to interfere with the loading of scaffolding elements, while at the same time providing additional protection to the workman.

While utility of the pallet of the invention involving locking of the scaffold end frames to the pallet is best served by stacking the end frames on the pallet as described, the invention also finds utility when the end frames are stacked on the pallet with the plane of the end frames vertical.

The invention has been described with reference to various embodiments thereof. However, the spirit and scope of the invention is to be as is defined by the following claims.

I claim as my invention:

1. An industrial pallet having a multi-function load supporting structure extending upward from a generally horizontal load-bearing platform, comprising, a generally rectangular, horizontal, load bearing platform member having a front edge, a back edge and two side edges which define the four corners of said platform member, said platform member being adapted to support a first load thereon, a first pair of rigid, vertically extending, load bearing posts mounted to said platform member adjacent to one of said side edges and spaced from the corners of said platform member, a second pair of rigid, vertically extending, load bearing posts mounted to said platform member adjacent to the other of said side edges and spaced fom the corners of said platform member, a third pair of rigid, vertically extending load bearing posts mounted to said platform member adjacent to said rear edge and spaced from the corners of said platform member, a first, generally horizontal, load bearing brace member extending between said first pair of posts, and a second, generally horizontal, load bearing brace member extending between said second pair of posts, said first and second load bearing brace members defining a generally horizontal plane on which a second load that spans the distance between said brace members may be supported.

2. An industrial pallet having a multi-function load supporting structure extending upward from a generally horizontal load-bearing platform, comprising, a generally rectangular, horizontal, load bearing platform member having a front edge, a back edge and two side edges, said platform member being adapted to support a first load thereon, a first pair of rigid, vertically extending, load bearing posts mounted to said platform member adjacent to one of said sides edges, a second pair of rigid, vertically extending, load bearing posts mounted to said platform member adjacent to the other of said sides edges, a third pair of rigid, vertically extending, load bearing posts mounted to said platform member adjacent to said rear edge, a first, generally horizontal, load bearing brace member extending between said first pair of posts, a second, generally horizontal, load bearing brace member extending between said second pair of posts, said first and second load bearing brace members defining a generally horizontal plane on which a second load that spans the distance between said brace members may be supported, a socket member located in said platform member adjacent to one of said load bearing posts, a link having a first end portion pivoted to said one load bearing post adjacent the upper end thereof, and having a second end portion, a manually removable locking rod extending vertically between said socket member and the second end portion of said link, and lock means cooperating with said link for non-removably securing said locking rod between said socket member and the second end portion of said link.

3. The pallet of claim 2 including a third generally horizontal brace member extending between said third pair of posts, and a fourth and a fifth generally horizontal, right angle brace member extending respectively between one of said third pair of posts and the adjacent one of said first and second pair of posts.

4. A pallet adapted for the support of a vertical stack of scaffold end frames, cross members, and planking from which a scaffold may be constructed, the pallet facilitating storage, transportation, and the like of the scaffold end frames, cross members and planking, the pallet comprising, a rectangular, metallic platform member defining a first horizontal, rectangular planar area, said platform member having;

a front edge portion over which scaffold end frames are adapted to be inserted, as the end frames are stacked on said platform member one at a time, a rear edge portion, and two side edge portions, a first pair of vertical, metallic posts mounted to said platform member adjacent one side edge portion thereof to assist in stacking of end frames on said platform member, a second pair of vertical, metallic posts mounted to said platform member adjacent the other side edge portion thereof to assist in stacking of end frames on said platform member, a third pair of vertical, metallic posts mounted to said platform member adjacent the rear edge portion thereof to assist in stacking of end frames on said platform member, horizontal, metallic bracing members mounted between each of said pairs of posts to provide a second storage plane that is spaced vertically above and parallel to said platform member, said second storage plane being adapted to receive scaffold cross members and/or scaffold planking, a closed bottom, open top socket member mounted in said platform member at a location in general alignment with one of said posts, a metallic locking rod having the lower end thereof received by said socket means, and means for selectively securing the upper end of said locking rod to said one post.

5. A pallet adapted for the support of a vertical stack of scaffold end frames, cross members, and planking from which a scaffold may be constructed, the pallet facilitating storage, transportation, and the like of the scaffold end frames, cross members and planking, the pallet comprising, a rectangular, metallic platform member defining a first horizontal, rectangular planar area, said platform member having, a front edge portion over which scaffold end frames are adapted to be inserted, as the end frames are stacked on said platform member one at a time, a rear edge portion, and two side edge portions.

a first pair of vertical, metallic posts mounted to said platform member adjacent one side edge portion thereof to assist in stacking of end frames on said platform member, a second pair of vertical, metallic posts mounted to said platform member adjacent the other side edge portion thereof to assist in stacking of end frames on said platform member, a third pair of vertical, metallic posts mounted to said platform: member adjacent the rear edge portion thereof to assist in stacking of end frames on said platform member, horizontal, metallic bracing members mounted between each of said pairs of posts to provide a second storage plane that is spaced vertically above and parallel to said platform member, said second storage plane being adapted to receive scaffold cross members and/or scaffold planking, a closed bottom, open top socket member mounted in said platform member in general alignment with one of said posts, a metallic locking rod having the lower end thereof received by said socket member, and a link pivotally mounted to the upper end portion of said one post, said link including a cup portion adjacent the free end thereof, such that said link may be pivoted to capture the top end of said locking rod in the cup portion thereof.

6. The pallet of claim 5 including locking means selectively operable to lock said link in association with the upper end of said locking rod.

* * * * *